US005271304A

United States Patent [19]

Wygal et al.

[11] Patent Number: 5,271,304

[45] Date of Patent: Dec. 21, 1993

[54] AUTOMATIC FOOD SLICING MACHINE

[75] Inventors: Gary L. Wygal, Durham; Peter D. Johnson, Seaside, both of Oreg.

[73] Assignee: Carruthers Equipment Co., Warrenton, Oreg.

[21] Appl. No.: 876,123

[22] Filed: Apr. 29, 1992

Related U.S. Application Data

[63] Continuation of Ser. No. 547,779, Jul. 3, 1990, abandoned.

[51] Int. Cl.[5] ..... B26D 7/06

[52] U.S. Cl. ..... 83/422; 83/408; 83/425.3; 83/435.2; 83/734; 83/932

[58] Field of Search ..... 83/422, 425.3, 426, 83/431, 734, 932, 409, 404.1, 407, 408, 425.2, 435.2, 425.1

[56] References Cited

U.S. PATENT DOCUMENTS

| | | | |
|---|---|---|---|
| 873,256 | 12/1907 | Motter | 83/408 |
| 1,772,397 | 8/1930 | Krejci | 83/435.2 |
| 3,880,035 | 4/1975 | Divan | 83/422 |
| 4,075,917 | 2/1978 | Kistner et al. | 83/422 |
| 4,163,406 | 8/1979 | Crawford | 83/435.2 X |
| 4,329,900 | 5/1982 | Dennis et al. | 83/422 X |
| 4,669,644 | 6/1987 | Nilsson | 83/408 X |
| 4,782,729 | 11/1988 | Mathot | 83/408 |
| 4,796,821 | 1/1989 | Pao et al. | 83/734 X |

*Primary Examiner*—Frank T. Yost
*Assistant Examiner*—Rinaldi Rada
*Attorney, Agent, or Firm*—Robert L. Harrington

[57] ABSTRACT

A conveying system for an automatic food slicing machine is disclosed. The conveying system has a floating upper conveyor positioned above a lower conveyor. The conveyors cooperatively feed the food item to be sliced an incremental length into the slicing knives during the feed cycle and retain the remainder of the food item during the cut-off cycle. An indexing mechanism, adjustable to provide different feed length increments and timed to the rotational cycle of the cut-off knife, drives the conveyors. The indexing mechanism only drives the conveyors during the feed cycle and the conveyors remain static during the cut-off cycle. The food item to be sliced is captively held between the upper and lower conveyors during both the feed cycle and the cut-off cycle. Small diameter rollers at the exit end of the conveyors are utilized and are positioned in close proximity to the travel path of the cut-off knife providing retentive capability throughout the feed length range.

4 Claims, 6 Drawing Sheets

AUTOMATIC FOOD SLICING MACHINE

This is a continuation of co-pending application Ser. No. 07/547,779 filed on Jul. 3, 1990, now abandoned.

BACKGROUND INFORMATION

1. Field of the Invention

This invention relates to machines for processing a food product and in particular it relates to a conveying system for an automatic slicing machine for processing meat products such as fish, beef, pork, poultry and the like.

2. Background of the Invention

Food items such as fish, beef, pork, poultry and the like are sliced into sized portions or cubes for subsequent processing such as canning.

The food items, such as fish fillets are cubed on a slicing machine. The machine is adjustable to produce a portion or cube of desired size.

The machine has a group of rotating circular knives that are spaced at a distance from each other with the spacing interval determining the width of the cube to be produced. The circular knives are positioned at an end of a conveyor system on the machine. The conveyor system transports the fillet into the circular knives which slice the food item into portions. An involute cut-off knife is provided for cutting the sliced portions to length. The involute cut-off knife rotational axis is normal to the rotational axis of the circular knives and as it rotates it will pass between the end of the conveyor system and the peripheral edge of the group of circular knives to cut the portions to length.

The conveyor system transports the fillet into the circular knives and as the fillet enters the circular knives it is sliced into strips. The conveyor system continues to feed the fillet into the circular knives until a desired length of the cube is sliced. At this point the conveyor system stops and the cut-off knife severs the sliced portions from the fillet. The height of the portions is determined by the natural height of the fillet. The spacing of the circular knives determines the width of the slice and the cut off knife severs the sliced portion to length.

Whereas slicing machines in current use and as generally described above for the most part are quite successful in "cubing" fillets, invariably a portion of the resulting cubes (more or less depending on cube size and food product) were cut to odd sizes, both smaller and larger than that for which the machine setting was designed. This variation was determined to be the result of the trailing end of the fillets being prematurely released by the conveyor system.

The conventional conveyor system consists of an upper drum or roller and lower belt conveyors that grip the food fillet as the fillet passes between them. The belt of the conveyor as used in prior slicing machines terminate at each end with a single roller that reverses the direction of the conveyor belt. One of the end rollers of the belt is a drive roller and typically that drive roller is at the discharge end of the conveyor. In any event, the end roller at the discharge end, engages the belt and retains contact with the belt over a 180 degree rotation of the roller to reverse the belt direction.

The position of the end roller and the drum at the discharge end is dictated by the path of the knives, i.e. the entry to the slicing station as it will sometimes hereafter be referred to. The forward most point on the roller, i.e. the point midway between the top and bottom positions whereat the belt engages and then disengages from the roller, and the forward most point on the drum cannot project into the path of the knives, i.e. it cannot extend beyond the slicing station entry. Yet the fillet being conveyed is released by the conveyor belt at the point where the belt engages the end roller. Thus, the point of release is rearward of the slicing station entry by at least a distance equal to the radius of the end roller. As the trailing end of the food fillet approaches this release point, the fillets can be prematurely released due to the pull of the slicing knives. This is undesirable and generates the variation in cube sizes.

BRIEF SUMMARY OF THE INVENTION

In the present invention, the problem of premature release of the food fillets is obviated by replacement of the conventional belt conveyor and drum with a conveyor system having an upper and lower belt type conveyor. A configured return guide on each conveyor is provided at the discharge end to reverse the belt direction in a manner that avoids the undesired circular end path generated by a conventional end roller.

Whereas the belt necessarily follows a curved path, the configured return guide of the preferred embodiment identifies the smallest radius curve practical for terminating the forward direction of the belt, i.e. for changing the belt direction by at least 90 degrees or from being horizontally directed to at least vertically directed (and preferably somewhat rearwardly directed). This "smallest" radius dictates the shortest distance between the point of food fillet release to the path of the knives, i.e. the knife station entry. The remaining portion of the return guide is designed to facilitate a smooth transition of the belt back to the rear end roller. This reconstruction of the discharge end of the conveyor system substantially eliminates premature release of the food fillets and substantial reduction of variable cube sizes generated thereby.

The invention will be more fully understood and appreciated upon reference to the following detail disclosure and drawings referred to therein.

DESCRIPTION OF THE PREFERRED EMBODIMENT

Figure 1:
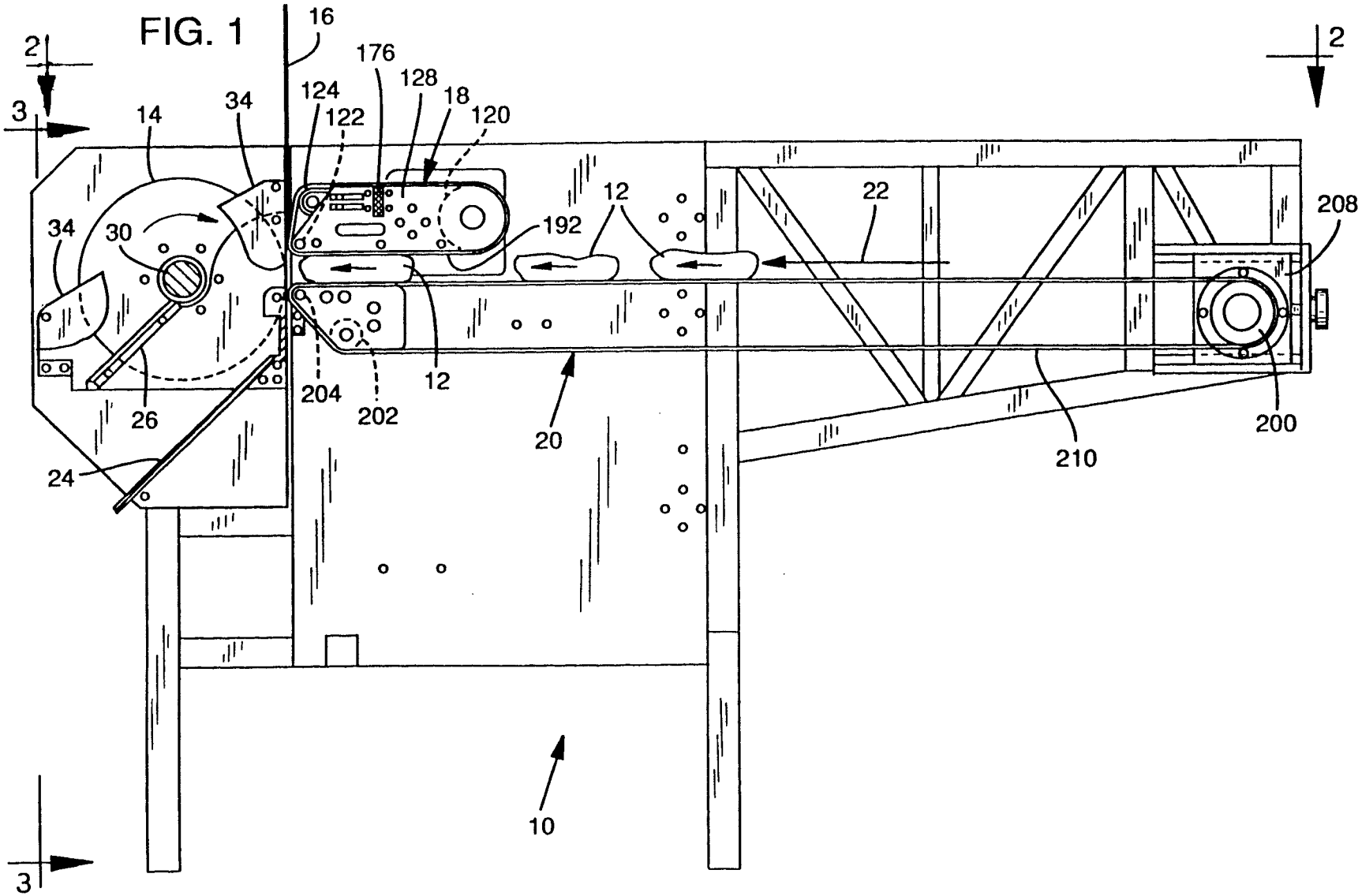
FIG. 1 is a side view of an automatic slicing machine in accordance with the present invention.

With reference to FIG. 1, illustrated is a slicing machine 10 for slicing a food item 12, such as fish, beef, pork, poultry and the like. The machine 10 has a group of rotatable circular slicing knives 14, a rotatable involute cut-off knife 16, and a conveyor system for conveying the food item to be sliced comprising an upper floating belt type conveyor 18 and a lower belt type conveyor 20.

Figure 3:
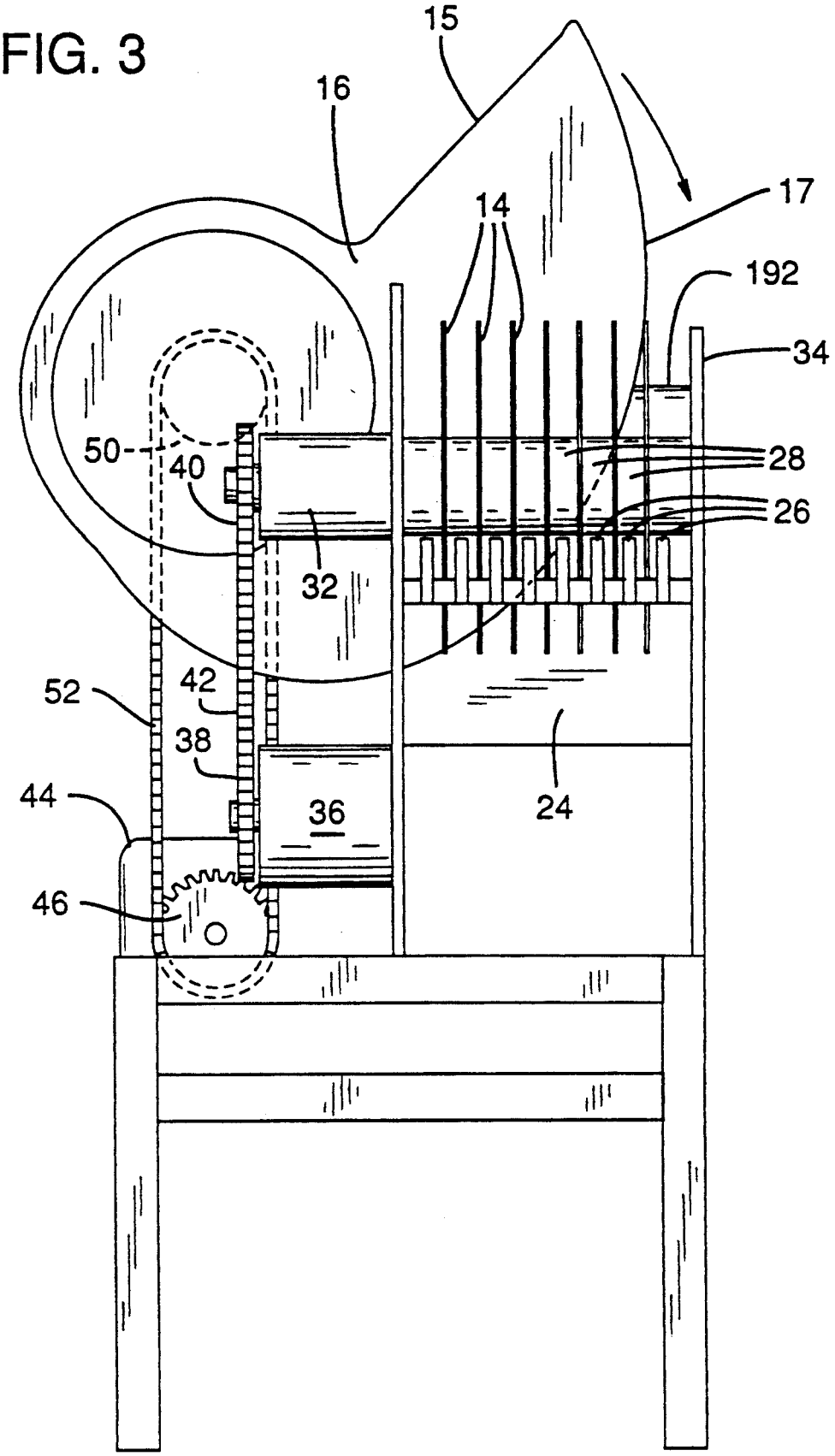
FIG. 3 is a front view of the machine of FIG. 1 showing the arrangement of the slicing and cut-off knives.

The slicing knives 14 as shown in FIG. 3 are spaced one from another by suitable spacers, the width of the spacers determining the width of the slice to be made in the food item 12. FIG. 3 also shows the involute cut-off knife 16.

Returning to FIG. 1, the conveyor system is driven by a drive mechanism that is timed to the rotational cycle of the cut-off knife 16. The drive mechanism will drive the upper and lower conveyors in concert an incremental distance during 180 degrees of rotation (referred to as the feed cycle) of knife 16. The incremental distance (which is adjustable) corresponds to the desired length of the slice produced by the knives 14. During the other 180 degrees of rotation of the knife 16, (which corresponds to the cut-off cycle) the conveyors are motionless.

Figure 2:
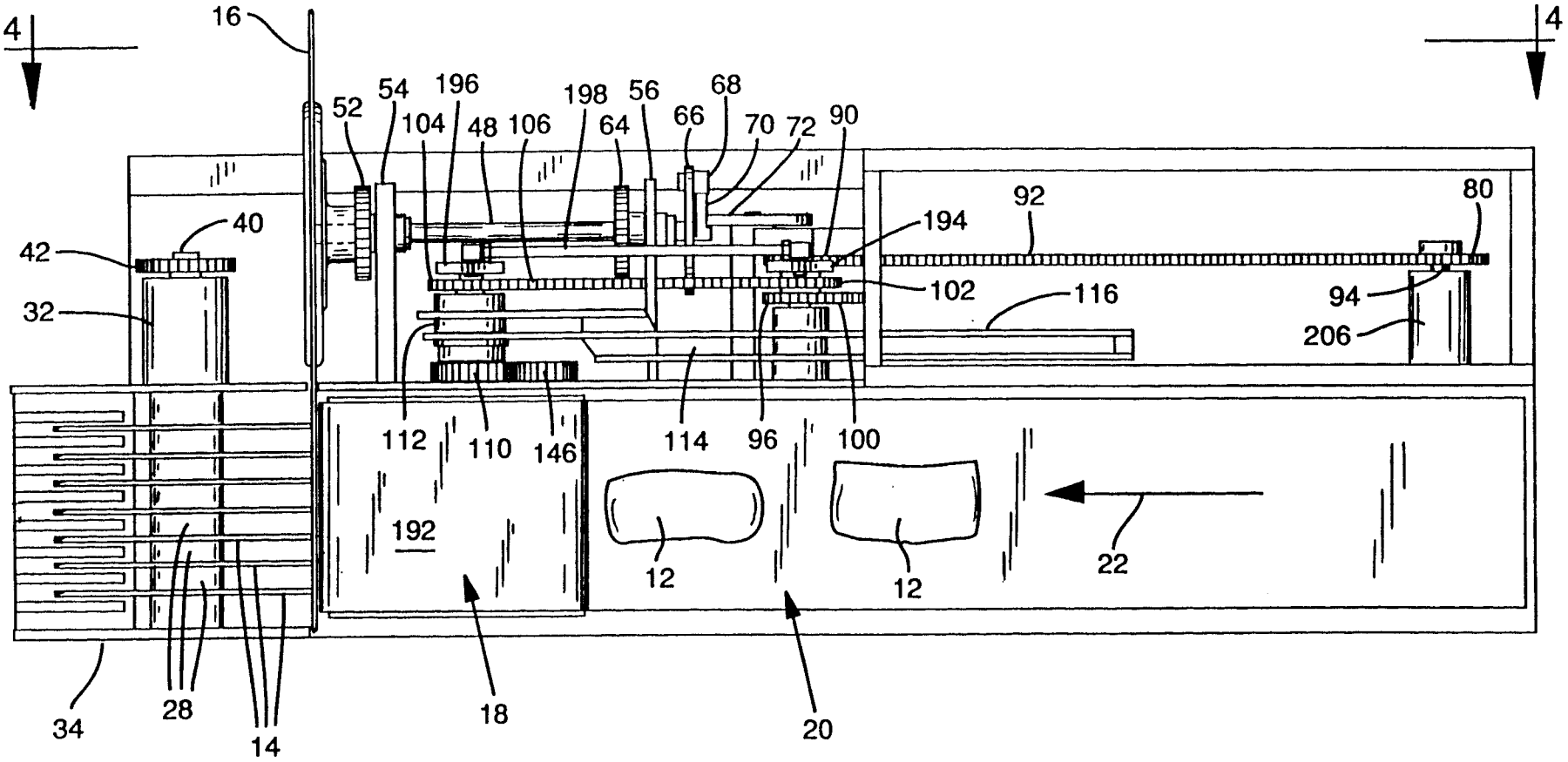
FIG. 2 is a top view of the machine of FIG. 1.

As shown in FIG. 1 and 2, a food item 12 such as a fillet of fish, is transported by the conveyor system toward and fed into the circular knives 14 as indicated by the directional arrow 22. The item 12 is received on the lower conveyor 20 and is transported incrementally toward the knives 14, with the item 12 entering between the upper conveyor 18 and the lower conveyor 20. The upper conveyor 18, having float capability, adjusts to the height of the item 12. The upper conveyor is weight biased downwardly toward the lower conveyor 20 and thus the item 12 is held captive between the upper conveyor 18 and the lower conveyor 20. The conveyors 18 and 20 cooperatively continue to transport the item 12 toward the knifes 14 an increment at a time. The item 12 leaving the ends of the conveyors (the conveyors thus feeding the item 12 into the knives) is sliced by the knives 14, the length of the slice corresponding to the feed length increment. During the cut-off cycle, the conveyors 18 and 20 are motionless and the cut-off knife 16 cuts the sliced portion from the item 12 remaining between the conveyors 18 and 20. The sliced portions or cubes exit through the knives 14 on a discharge chute 24. Fingers 26 positioned between adjacent knives 14 insure that the cubes exit from the knives 14. At the end of the cutoff cycle, the conveyors 18 and 20 once again advance the remainder of item 12 held captive between the upper conveyor 18 and the lower conveyor 20 into the knives 14 another incremental distance and the knife 16 cuts off the newly sliced portion. This repetitive cycle continues until the item 12 (and subsequent pieces) has been sliced into the desired cubes.

It will be appreciated that as the item 12 enters the slicing knives 14, there is a tendency for the knives 14 to pull the item 12 off the conveyor system. This is prevented by the item 12 being held captive between the upper conveyor 18 and the lower conveyor 20.

FIGS. 2 and 3 show the arrangement of the circular knives 14 and the involute cut-off knife 16. The circular knives 14 are disc type, being sharpened at the peripheral edge and are spaced from one another by spacers 28. The width of the spacers 28 correspond to the desired width of slice produced by the knives 14. The circular knives 14 are mounted on an arbor 30 in a conventional manner and as shown, one end of the arbor 30 is mounted in the bearing housing 32 and the opposite end is rotatably supported by an outboard housing 34.

The involute cut-off knife 16 is rotatably bearing mounted with its rotational axis transverse to the rotational axis of the circular knives 14. As shown, the cutting portion 17 of the knife 16 is an involute segment formed on approximately 180 degrees of arc which is sharpened on its periphery. As the knife 16 rotates, the cutting portion 17 of the knife 16 passes between the exit end of the conveyor 18 and 20 and the peripheral edges of the knives 14.

Figure 4:
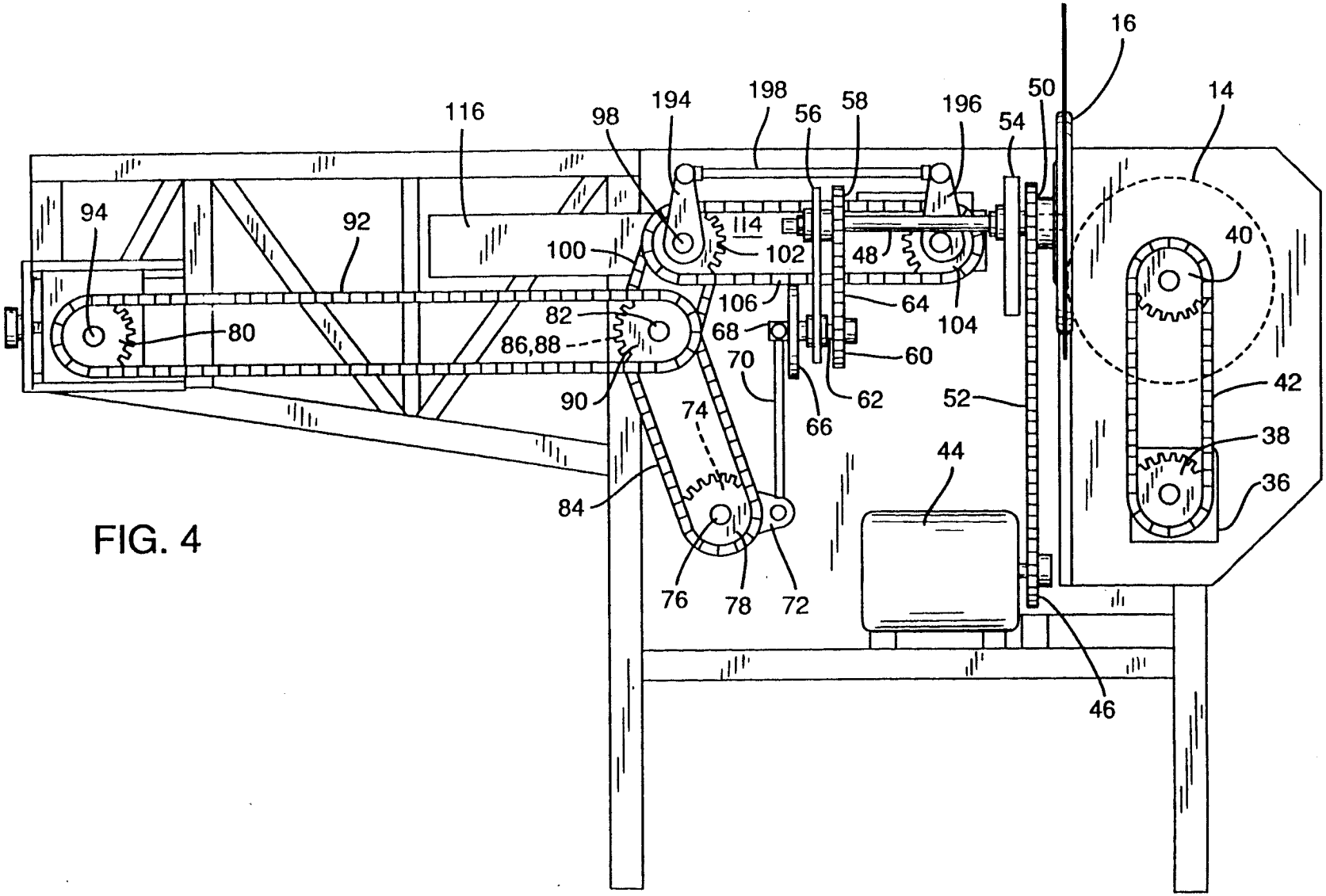
FIG. 4 is a side view of the machine opposite that of FIG. 1 and showing the drive mechanism for the knives and the conveyors.

FIG. 4 (and FIG. 2) shows the drive mechanisms for rotatably driving the knives 14, the knife 16 and the indexing mechanism for driving the conveyors 18 and 20.

The knives 14 are driven by a drive motor 36. The drive motor 36 has a drive sprocket 38 coupled to a driven sprocket 40 attached to arbor 30. The arbor 30 is rotatably mounted in the bearing housing 32. An endless roller chain 42 couples the drive sprocket 38 to the driven sprocket 40.

The knife 16 is driven by a motor 44. The motor 44 has a drive sprocket 46 coupled to a driven sprocket 50 on a shaft 48 by an endless chain 52. The shaft 48 is suitably bearing mounted near each of its ends in frame members 54 and 56 and as shown, the knife 16 is mounted on one end of the shaft 48.

A drive sprocket 58 is mounted on the shaft 48 (near the frame member 56) and is aligned with a driven sprocket 60 mounted on one end of a jack shaft 62. An endless chain 64 couples the drive sprocket 58 to the driven sprocket 60. The jack shaft 62 is rotatably bearing mounted in the frame member 56 and as viewed in the figure, the shaft 62 is below and parallel to the shaft 48.

A drive wheel 66 is mounted on the opposite end of the jack shaft 62. Adjustably mounted on the drive wheel 66 is a stub shaft 68. The stub shaft 68 whose longitudinal axis is parallel to the longitudinal axis of the jack shaft 62 is adjustable radially on the drive wheel 66 as by a screw or turnbuckle mechanism. By adjusting the radial position of the stub shaft 68 on the wheel 66, the length of path traveled (i. e., the circumference) by the stub shaft may be changed.

One end of a pitman 70 is rotatably mounted on the stub shaft 68. The opposite end of the pitman 70 is pivotally bearing mounted to a pivot arm 72 of an overrunning clutch 74 (i.e., a one way drive clutch). The clutch 74 is rotatably mounted on a shaft 76 affixed to the structure of the machine 10. As viewed in the figure, the axis of rotation of the clutch 74 is normal to the axis of rotation of the shaft 48. A drive sprocket 78 is fitted to the clutch 74 and is aligned with a driven sprocket 80 rotatably mounted on a shaft 82 affixed to the structure of the machine 10. An endless chain 84 couples the drive sprocket 78 to the driven sprocket 80.

A sprocket 86 and a sprocket 88 are rotatably mounted on the shaft 82 and are affixed to the driven sprocket 80. The sprocket 86 is aligned with the lower conveyor drive sprocket 90 which is affixed to the lower conveyor drive shaft 94. An endless chain 92 couples the sprocket 86 and the sprocket 90.

The sprocket 88 is aligned with a driven sprocket 96 rotatably mounted on the swing arm pivot shaft 98 and the sprockets 88 and 96 are coupled by an endless drive chain 100. Affixed to the driven sprocket 96 and aligned with an upper conveyor drive sprocket 104 is a drive sprocket 102 An endless chain 106 couples the sprockets 102 and 104.

The sprocket 104 is rotatably mounted on one side of the housing 112 on the cross member 130 of the upper conveyor extending into and through the housing 112. The sprocket 104 is coupled, as by a drive sleeve, to a gear 110 that is rotatably mounted on the cross member 130 on the opposite side of the housing 112. The sleeve (not shown) is rotatable within the housing 112 and is supported on suitable bearings in a conventional manner. The gear 110 is aligned and in mesh with the spur gear 146 mounted to the upper conveyor drive shaft 136. A spacer 131 (shown in FIG. 5), comparable to spacer 144 is provided for aligning the gear 110 with gear 146.

In operation, the drive motor 36 coupled to the arbor 30 mounted in the bearing housing 32 provides continuous rotation of the knives 14. The drive motor 44 coupled to the shaft 48 provides continuous rotation of the involute cut-off knife 16.

The shaft 48 in turn is coupled to the shaft 62 which rotates the wheel 66 mounted on shaft 62. The rotating wheel 66 thus provides reciprocal motion to the pitman 70 connected to the one way clutch. The wheel 66 is timed to the knife 16 such that as the trailing edge 15 of the involute section 17 of the knife 16 passes the exit end of the conveyors 18 and 20, the pitman 70 is at the top of its stroke as viewed in the figures. As the pitman 70 descends from the top of its stroke to the bottom of its stroke, thus pivoting the pivot arm 72, the one way clutch is engaged to rotate the sprocket 78. The degree of rotation of the sprocket 78 is dependent on the stroke length of the pitman 70. The stroke length of the pitman, as previously stated, is adjustable by adjusting the radial position of the stub shaft 68 on the wheel 66. The sprocket 78 which is coupled to the drive mechanism for the upper and lower conveyors will thus index (i.e., move) the belts of the conveyors in unison an incremental feed distance. The 180 degree portion of the knives 16 opposite the involute section 17 provides a clear passage for the product 12 to pass from the conveyors 18 and 20 into the circular knives 14 during the feed cycle.

As the pitman 70 moves from the bottom of its stroke to the top of its stroke, the pivot arm 72 is pivoted in the opposite direction, the clutch 74 is disengaged, the sprocket 78 does not rotate and therefore the conveyors are static, that is motionless. During the upstroke of the pitman 70, the involute segment 17 of the knife 16 will pass between the circular knives 14 and the exit end of the conveyors to cut the sliced portions to length.

Figure 5:
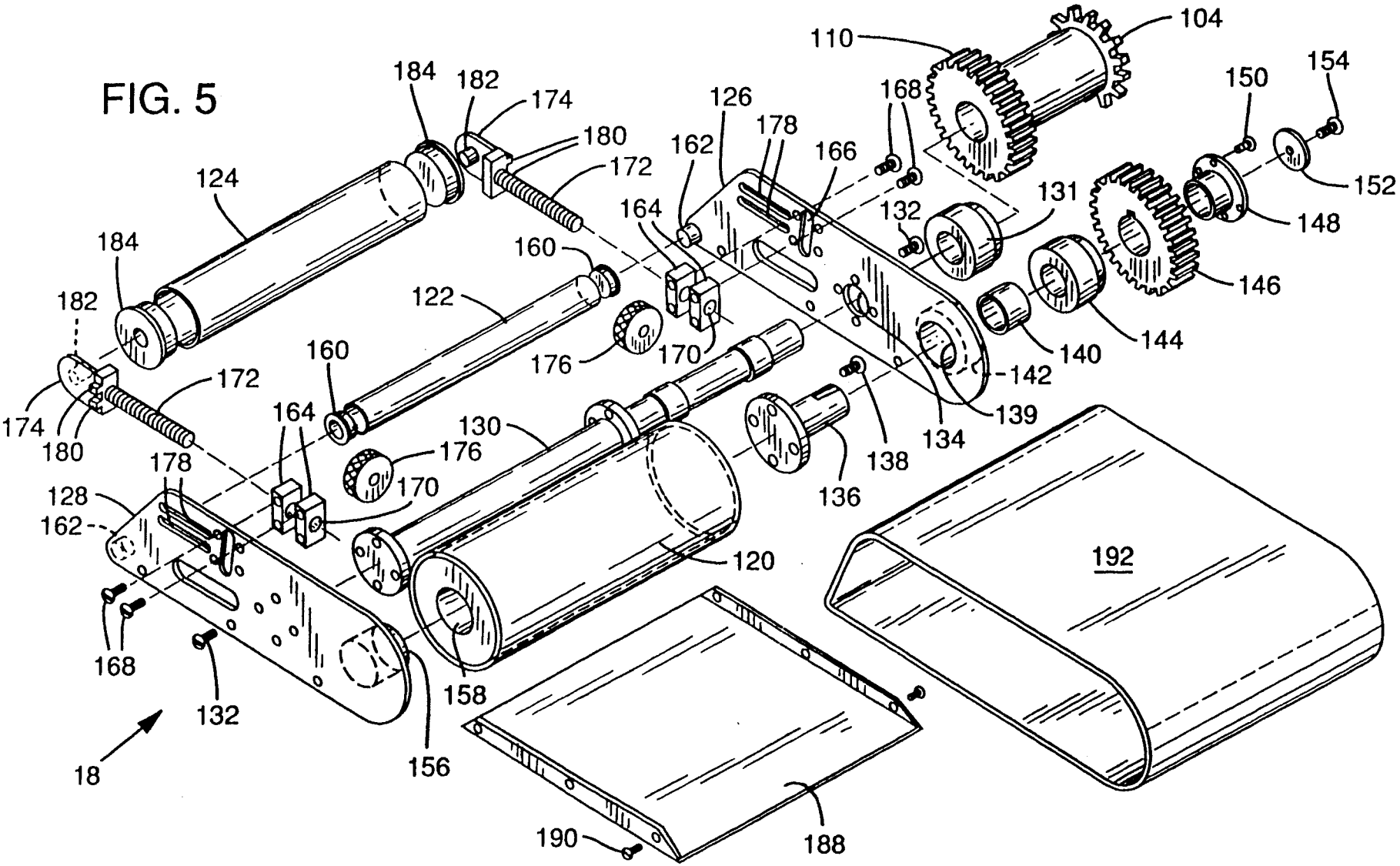
FIG. 5 is an exploded view of an upper conveyor.

Refer now to FIG. 5 of the drawings which shows the upper conveyor 18 in exploded view. The upper conveyor has a drive roller 120, a nose roller 122, and a tension roller 124 that are rotatably mounted between an inner retaining plate 126 and an outer retaining plate 128. The retaining plates 126 and 128 are maintained in a spaced relationship by a cross member 130 that is fixedly attached to the plates by fasteners 132. As shown, the cross member extends through a bore 134 provided in the inner plate 126 and is mountable in the housing 112 of the swing arm 114.

A pulley drive shaft 136 is mountable to one end of the drive roller 120 by fasteners 138 and extends through a bore 139 in the inner plate 126 where it is rotatably supported in a bushing 140 fitted in a bushing support 142 that is fixedly attached to the inner plate 126 as by welding. A spacer 144 and a spur gear 146 with hub 148 are mountable on the shaft 136. As shown, the gear 146 is mounted to the hub 148 by fasteners 150. The drive shaft 136 and the hub 148 are keyed in a conventional manner. The gear, hub and spacer are retained on the shaft by a retaining washer 152 attached to the end of the shaft 136 by a fastener 154. The fastener 154 is threadably installed in a threaded bore (not shown) in the end of the shaft. When assembled, the gear 146 is aligned with and is in mesh with the drive gear 110.

A stub shaft 156 fixedly attached to the outer plate 128, as by welding, rotatably supports the opposite end of the roller 120. The stub shaft 156 fits within a bore 158 in the drive roller 120.

Roller end caps 160, having center bores, are provided at each end of the small diameter nose roller 122 for rotatably mounting the roller 122 on studs 162 provided on each of the plates 126 and 128.

A tension block 164 is fastened on each side of a rectangular opening 166 provided in each of the retainer plates 126 and 128 by fasteners 168. As shown, each block 164 has a through bore 170 which will accept the slidable insertion of the threaded adjusting stud 172 affixed to the tensioner bracket 174. A knurled adjusting nut 176 having a threaded center through bore will fit loosely between the tension blocks 164 and extend partially through the opening 166. The nut 176 will engage the adjusting stud 172 inserted in the bores 170 of the block 164.

Each of the retaining plates 126 and 128 have a pair of elongate parallel slots 178 positioned relative to the rectangular openings 166 as shown in the figure.

The brackets 174 have protruding lugs 180 spaced at a distance from each other to fit slidably in the parallel slots 176. A stub shaft 182 is provided on each bracket 174 for supporting the tension roller 124.

End caps 184, having center bores, are fitted on each end of the tension roller 124 for rotatably mounting the roller 124 on the stub shafts 182 on the brackets 174.

The roller 124 mounted on the brackets 174 is guidably moved relative to the plates 126 and 128 by rotating the knurled nuts 176 threadably engaged with the adjusting studs 172. The nuts 176, being captive between the tension blocks 164, impart motion to the roller 124 mounted on the brackets 174 via the studs 172 and the protruding lugs 180 fitted in the slots 176 guide the roller. Each end of the roller may be moved independent of the other by rotating the nuts independently.

A support pan 188, which serves as a platen for the belt 192, is fastened between the inner and outer plates by fasteners 190. An endless belt 192 having a width corresponding to the length of the rollers 120, 122 and 124 and of suitable length to encircle the perimeter defined by the rollers is fitted over the rollers of the upper conveyor 18. The belt is tensioned by adjusting the knurled nuts 176 which moves the tension rollers relative to the side plates and therefore the belt. By adjusting the nuts 176 individually, proper "tracking" of the belt on the rollers is maintained. The belt 192 is easily and rapidly removed for cleaning or replacement by releasing the tension on the belt by rotation of the nuts 176 and simply sliding the belt off the side of the conveyor 18.

The swing arm 114 as shown in FIGS. 2 and 4 is pivotally mounted on the shaft 98. A housing 112 is provided at one end of the swing arm 114 for supporting the upper conveyor 18. As previously stated, the end of the cross member 130 is mounted in the housing 112. Pivotal movement of the swing arm 114 on its pivot axis (i.e., axis of shaft 98) will thus raise or lower the upper conveyor 18 relative to the lower conveyor 20.

An arm bracket 194 is fixedly attached to the end of the pivot shaft 98 and a similar arm bracket 196 is fixedly attached to the end of the cross member 130 extending through the housing 112. One end of an extension tube 198 is pivotally mounted to the bracket 194 and the opposite end of the extension tube is pivotally mounted to the bracket 196. One end of the extension tube has an adjusting stud with right hand threads and the opposite end of the tube has an adjusting stud with left hand threads. The effective tube length then may be adjusted by simply rotating the tube relative to the studs. The change of the effective length of the tube will pivotally adjust the angle of the upper conveyor in reference to the lower conveyor by pivoting the cross member 130 in the housing 112. As the swing arm is pivoted about its pivot axis, the upper conveyor will maintain the adjusted angle in reference to the lower conveyor. It is preferable to have the upper conveyor belt parallel to the belt of the lower conveyor.

The end section, generally indicated by the numeral 116, of the swing arm 114 has counter weights that are moveable relative to the pivot axis to adjust the downward weight biasing force of the conveyor 18. As previously stated, the upper conveyor 18 is urged in a direction toward the lower conveyor 20 by a weight biasing force generally provided by the weight of the assembly. The weight biasing force is thus adjusted by moving the counter weights on section 116. It is also apparent that additional weights ma be added or weights removed from the section 116 as required. Adjustable counterweight mechanisms are well known and therefore have not been detailed in the drawing figures.

The lower conveyor 20 as shown in FIGS. 1 and 2, has a drive roller 200, an idler roller 202 and a nose roller 204. One end of the drive roller 200 is fastened to the drive shaft 94 which is rotatably supported in a moveable drive shaft bracket and housing assembly 206. The opposite end of the drive roller is rotatably supported in a moveable end bracket 208. The idler roller 202 and the nose roller 204 are rotatably supported on the frame of the machine 10 in a conventional manner. A belt 210, having a width corresponding to the length of the drive, idler, and nose rollers and of suitable length to encircle the perimeter defined by the rollers is fitted on the rollers. The moveable brackets 206 and 208 are utilized to tension the belt 210 and also by independently adjusting provide "tracking" control of the belt.

Figure 6:
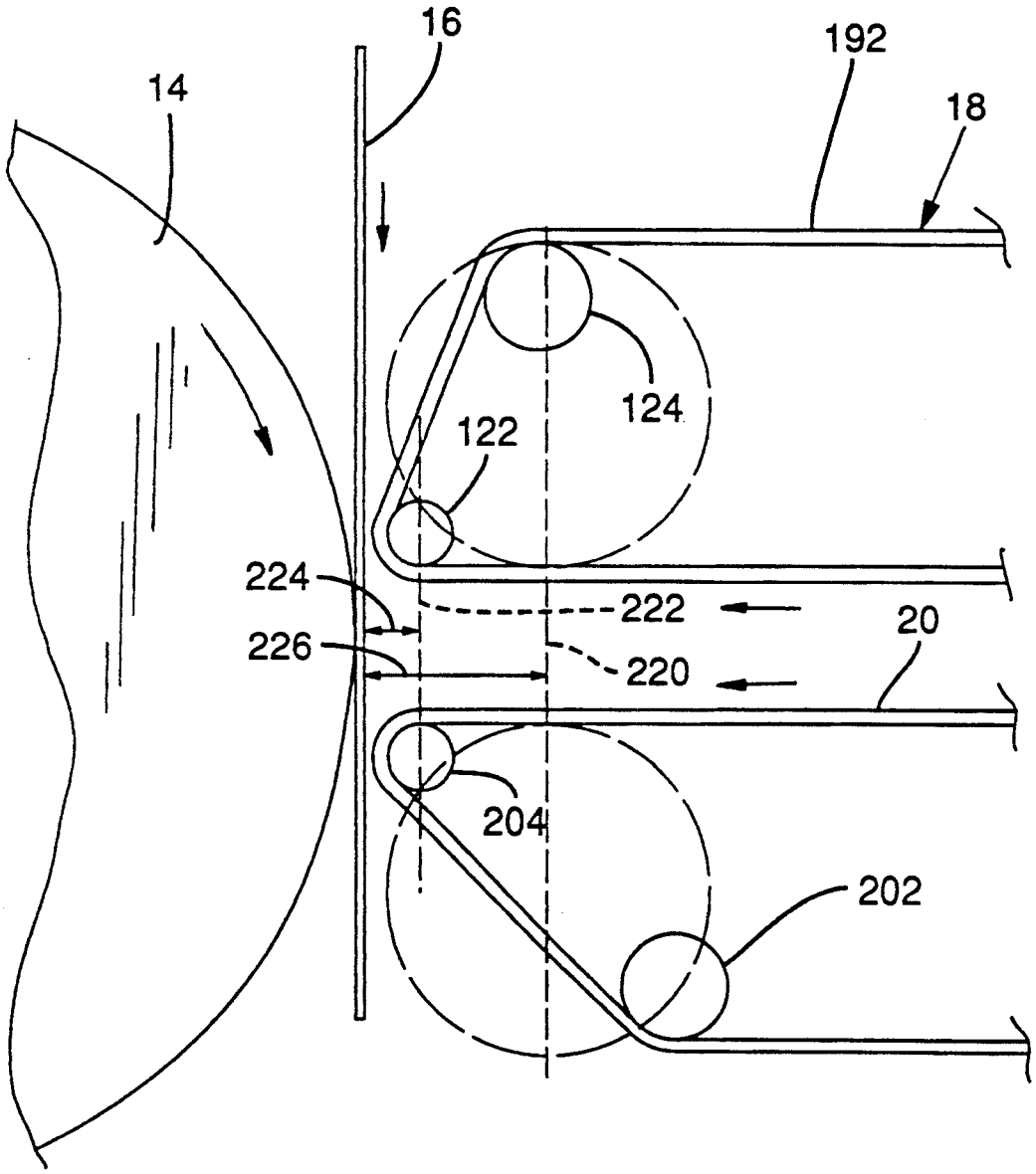
FIG. 6 is a comparative illustration showing the relation of the slicing and cut-off knives to conveyor systems, comparing the present system to the known prior systems.

Refer now to FIG. 6 of the drawings. It shows the relationship of the knives 14, the knife 16, to the upper conveyor 18 and lower conveyor 20. Also shown in dashed lines are nose rollers for conveyor system having the same diameter as the drive rollers. It is also applicable to a system used in prior machines that utilized a lower conveyor with a larger diameter feed roller disposed above the lower conveyor.

In order to maintain a consistent length of the portions or cubes sliced from the item, the item and especially the trailing end of the item must be retainable by the conveyor system throughout the slicing operation. This is particularly true when slicing cubes of small dimensions (i.e. ½" long). As shown in the figure, the conveyor with the large diameter return rollers loses its retentive capability when the trailing end of the item passes the imaginary plane indicated by the dashed line 220. The conveyor system of the present invention utilizing the small diameter rollers of the configured return guide does not lose its retentive capability until the trailing end of the item passes the imaginary plane indicated by the line 222.

The conveyor system of the present invention will control the item much closer to the cut-off knife than a conveyor system having conventional return rollers. The comparative distances are indicated by the bi-directional arrows the arrow 224 representing the conveyor system of the present invention and the arrow 226 representing the prior conveyor system.

It will be apparent to those skilled in the art that modifications and variations may be made without deviating from the true spirit and scope of the invention. The scope of the invention is not to be limited to the drawings and the preferred embodiment but is to be determined from the appended claims.

What is claimed is:

1. An automatic slicing machine for slicing fillets of food material into cubes comprising;

a plurality of rotatable circular knives having peripheral cutting edges and arranged in parallel spaced relation, a conveyor system for feeding fillets of food material along a feed path substantially radially directed into said circular knives for slicing the fillets into lengthwise strips of pre-determined width, a cut off knife that repetitively cycles through said feed path adjacent to said peripheral cutting edges of said circular knives, said cut off knife thereby defining a cutting plane, said cut off knife cutting the lengthwise strips into cubes of food material of pre-determined length;

said conveyor system comprising:

a bottom endless belt for receiving and conveying food material fillets along said feed path, and an upper endless belt positioned in spaced relation over said bottom belt, said upper belt being adjustable in its relative spacing over said bottom belt and directed along said feed path, and said upper and lower belts of appropriate material and configuration to cooperatively grip fillets of food material being conveyed by said bottom endless belt, each of said endless belts directed along said feed path to a forward-most position adjacent said cutting plane, a first reversing guide member at said forward-most position to reverse the travel of the belt away from said feed path in a rearward direction to a rearward-most position, and a second reversing guide member at said rearward-most position to redirect the belt in a forward direction along the feed path;

said first reversing guide member of each of said upper and lower belts including a first guide element that guides the belt substantially in a straight path to a point of adjacency with said cutting plane and there defines a curvature for redirecting the belt, which curvature is the smallest radius that the belt can accommodate over about a 90 degree angle of curvature, said radius being no greater than about one-half inch, said first guide element directing the belt along a substantially vertically directed path to a second guide element, said second guide element of the upper belt positioned above and behind said first guide element and said second guide element of said lower belt positioned below and rearwardly of said first guide element, said second guide element of each of said upper and lower belts completing the reversal of said belt direction to be thereafter rearwardly directed toward said second reversing guide member; and said first guide element of each of said upper and lower belts defining a path of curvature of the belt having a radius that is no greater than said predetermined length of said cubes.

2. An automatic slicing machine as defined in claim 1 wherein the first guide elements are substantially minimum radiused idler rollers.

3. An automatic slicing machine as defined in claim 1 including adjusting means for said upper belt that automatically adjusts the upper belt to the food fillet thickness, and including biasing means pressuring the upper belt against the food fillets to induce cooperative gripping of the food fillet between the belts.

4. In a food processing apparatus adapted for moving food product along a conveyance path into a slicing station executing parallel longitudinal cuts along a first dimension parallel to the conveyance path and consecutive transverse cuts along a second dimension transverse to the conveyance path to form substantially cube shaped processed food product of determined lengths, the slicing station including an entry defined by a plane transverse to the conveyance path, the slicing station being positioned on a first side of said plane with a transverse cutting blade executing said transverse cuts and positioned immediately adjacent said plane, the path of conveyance beginning on the opposite side of said plane and passing through the plane, a conveyor being positioned on the opposite side of said plane for moving said food product into said plane, and longitudinal cutting blades having substantially vertical cutting edges proximate to the transverse cutting blade on a side opposite said plane, the conveyor comprising:

a lower belt assembly having a leading lower curved guide surface adjacent said plane and additional lower guide rollers and drive means for directing an endless lower belt about said leading curved guide surface and said additional lower guide rollers;

an upper belt assembly having a leading upper curved guide surface adjacent said plane and additional upper guide rollers and drive means for directing an endless upper belt about said leading curved guide surface and said additional upper guide rollers; and incremental drive means for moving food product captured between said upper and lower belts in coordination with execution of transverse cuts by the slicing station to provide said consecutive transverse cuts, said incremental drive means adapted to provide a given separation between consecutive transverse cuts, said upper and lower belts of appropriate material and configuration and including planar food product engaging portions in face-to-face relation and positionable in spaced relation therebetween for capturing said food product and moving the food product incrementally along the conveyance path toward the plane in response to said incremental drive means, said longitudinal cutting blades being circular slicing blades rotated on an axis of rotation, said cutting edge provided on the curved peripheral edge of the blade, said conveyance path directing said food product substantially horizontally and radially into the circular blades, said leading lower curved guide surface and said leading upper curved guide surface defining a curvature for redirecting the respective lower and upper belts, said curvature being the smallest curvature that the belt can accommodate over about a 90 degree angle of curvature, said smallest radius being no greater than about one-half inch whereby food product can be gripped by said upper and lower belts within about one-half inch of the transverse cutting blade.

* * * * *